US007201593B2

(12) United States Patent
Kondas et al.

(10) Patent No.: US 7,201,593 B2
(45) Date of Patent: Apr. 10, 2007

(54) JUMPER ASSEMBLY FOR AN ELECTRICAL DISTRIBUTION SYSTEM

(75) Inventors: Shawn Kondas, Kendallville, IN (US); Daniel Hayes, Kendallville, IN (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 11/252,489

(22) Filed: Oct. 18, 2005

(65) Prior Publication Data

US 2006/0084310 A1 Apr. 20, 2006

Related U.S. Application Data

(60) Provisional application No. 60/620,008, filed on Oct. 19, 2004.

(51) Int. Cl.
*H01R 4/60* (2006.01)

(52) U.S. Cl. ..... 439/215

(58) Field of Classification Search ..... 439/215, 439/211, 490–499
See application file for complete search history.

(56) References Cited

U.S. PATENT DOCUMENTS

| | | | | | |
|---|---|---|---|---|---|
| 2,952,829 | A | * | 9/1960 | Grohsgal | 439/214 |
| 4,382,648 | A | * | 5/1983 | Propst et al. | 439/209 |
| 4,445,741 | A | * | 5/1984 | Annoot | 439/290 |
| 4,775,328 | A | * | 10/1988 | McCarthy | 439/211 |
| 4,875,871 | A | * | 10/1989 | Booty et al. | 439/209 |
| 4,918,886 | A | * | 4/1990 | Benoit et al. | 174/497 |
| 4,950,178 | A | | 8/1990 | Harvey et al. | 439/507 |
| 4,992,058 | A | * | 2/1991 | Tanner | 439/211 |
| 5,096,433 | A | * | 3/1992 | Boundy | 439/215 |
| 5,186,640 | A | * | 2/1993 | McCoy | 439/211 |
| 5,199,891 | A | * | 4/1993 | Reed | 439/98 |
| 5,236,370 | A | | 8/1993 | King et al. | 439/215 |
| 5,277,609 | A | * | 1/1994 | Ondrejka | 439/215 |
| D356,295 | S | | 3/1995 | Shoda et al. | D13/146 |
| 5,466,172 | A | | 11/1995 | Carstens et al. | 439/509 |
| D373,724 | S | | 9/1996 | Adams et al. | D13/147 |
| D373,994 | S | | 9/1996 | Kammersgard et al. | D13/146 |
| D373,995 | S | | 9/1996 | Kammersgard et al. | D13/147 |
| D412,700 | S | * | 8/1999 | Gardner et al. | D13/147 |
| 5,986,210 | A | * | 11/1999 | Kummle et al. | 174/59 |
| 6,250,957 | B1 | * | 6/2001 | Chang | 439/541.5 |
| 6,475,032 | B1 | * | 11/2002 | Dvorak | 439/606 |
| 6,558,185 | B1 | | 5/2003 | Stockel et al. | 439/465 |
| 6,575,777 | B2 | | 6/2003 | Henriott et al. | 439/315 |
| 6,648,676 | B1 | * | 11/2003 | Lee | 439/499 |
| 6,902,415 | B2 | * | 6/2005 | Ramsey et al. | 439/215 |
| 7,090,538 | B1 | * | 8/2006 | Huang | 439/638 |
| 2005/0130476 | A1 | * | 6/2005 | Kochanski | 439/215 |
| 2006/0084309 | A1 | * | 4/2006 | Kondas | 439/215 |
| 2006/0160388 | A1 | * | 7/2006 | Hughes et al. | 439/181 |

* cited by examiner

*Primary Examiner*—Tho D. Ta
*Assistant Examiner*—Larisa Tsukerman
(74) *Attorney, Agent, or Firm*—Taylor & Aust, P.C.

(57) ABSTRACT

An electrical jumper assembly for an electrical distribution system, where the electrical jumper assembly includes at least one conductor carrier generally having a longitudinal direction, and a plurality of conductors in the at least one conductor carrier. A first electrical connector is connected to the plurality of conductors. The first electrical connector includes a first part directly connected to at least one conductor carrier, and a second part which has a plurality of terminals electrically connected to respective ones of the plurality of conductors. The second part is laterally offset from the first part, and the second part is approximately parallel to the longitudinal direction.

14 Claims, 7 Drawing Sheets

JUMPER ASSEMBLY FOR AN ELECTRICAL DISTRIBUTION SYSTEM

CROSS REFERENCE TO RELATED APPLICATIONS

This is a non-provisional application based upon U.S. provisional patent application Ser. No. 60/620,008, entitled "OFFSET JUMPER", filed Oct. 19, 2004.

BACKGROUND OF THE INVENTION

1. Field of the Invention

The present invention relates to an electrical distribution system, and, more particularly, to a jumper assembly for an electrical distribution system.

2. Description of the Related Art

Conventional electrical distribution systems include a power service entry into a circuit breaker or fuse box, and then distribution of conductors from the circuit breaker or fuse box to electrical receptacles, lights, electrical machinery, and the like. In the case of commercial buildings, and in other situations, the conductors may be routed through an exposed ceiling to be connected to lighting, and/or dropped to a lower level to connect into power receptacles or electrical controls which are easily accessible by a user, for example. Such ceiling and other conductors may be required to be enclosed within conduit. The process then involves installing the conduit, pulling the conductor circuits through the conduit, and then connecting the conductors to appropriate circuit breaker or fuses within the electrical box. Further, if multiple lights are connected to a given circuit, for example, junction boxes may be required where branch conductors, going to individual lights for example, are connected to the circuit. This process can be time consuming and expensive, as it generally requires highly skilled installation personnel. Further, add-on modifications to the system typically requires that additional conduit be installed, and conductors pulled therethrough to installed junction boxes, then the conductors finally connected to the add-on electrical appliance, outlet, etc. Additionally, such an installation can be somewhat dangerous in that it requires the installation personnel to stand on ladders, or the like, and perform a multitude of tedious operations.

An electrical distribution system can be envisioned which includes one or more prefabricated distribution harnesses each with multiple connectors, and where branch circuits are connected into a distribution harness by simply connecting a mating connector to a respective harness connector. However, elements must be provided to mechanically mount the distribution harnesses to the ceiling structure, and such elements can provide obstacles particularly when attempting to interconnect adjacent distribution harnesses. The need to interconnect adjacent distribution harnesses stems from the fact that the conductors, and corresponding circuits, within a distribution harness may support more branch circuits than which the number of connectors of the distribution harness can be, or is, connected with. Therefore a jumper assembly is needed to interconnect adjacent distribution harnesses and thereby provide electrical connection from one distribution harness to an adjacent distribution harness and thus allows for more branch circuits and/or electrical distribution and access to a broader area.

A cable connector or jumper is known for providing alternating current (AC) between adjacent electrical modules which includes a first head member having a set of recessed prongs, a second head member having a set of recessed mating apertures, and a semi-rigid, tubular connecting member. The prongs and recessed mating apertures are oriented at 90° to the tubular connecting member. A problem with such a cable connector is that it only includes three conductors (line, neutral and ground) and is therefore only suitable for a system that includes a single circuit. Such a cable connector is only suitable for a system which includes power conductors, and has no features which accommodate direct current (DC) conductors. Further, having prongs and recessed mating apertures which are oriented at 90° to the tubular connecting member, such a cable connector is not suitable to interconnect adjacent in-line distribution harnesses with connectors which are parallel with the distribution harnesses.

What is needed in the art is a jumper assembly which can interconnect adjacent in-line distribution harnesses with connectors which are parallel with the distribution harnesses, and which can avoid mechanical obstacles in so doing.

SUMMARY OF THE INVENTION

The present invention provides a jumper assembly which can interconnect adjacent in-line distribution harnesses with connectors which are parallel with the distribution harnesses, and which can avoid mechanical obstacles in so doing.

The invention comprises, in one form thereof, an electrical distribution system, which includes an electrical distribution harness with an electrical distribution connector and an electrical jumper assembly connected to the electrical distribution connector. The electrical jumper assembly includes at least one conductor carrier generally having a longitudinal direction and a plurality of conductors in the at least one conductor carrier. A first electrical connector is connected to the plurality of conductors, the first electrical connector has a first part directly connected to the at least one conductor carrier, and a second part which has a plurality of terminals electrically connected to respective ones of said plurality of conductors. The second part is laterally offset from the first part, and the second part is approximately parallel to the longitudinal direction.

The invention comprises, in another form thereof, an electrical jumper assembly, which includes at least one conductor carrier generally having a longitudinal direction, and a plurality of conductors in the at least one conductor carrier. A first electrical connector is connected to the plurality of conductors, the first electrical connector includes a first part directly connected to at least one conductor carrier, and a second part which has a plurality of terminals electrically connected to respective ones of the plurality of conductors. The second part is laterally offset from the first part, and the second part is approximately parallel to the longitudinal direction.

The invention comprises, in another form thereof, a method of interconnecting a first electrical distribution harness and a second electrical distribution harness in an electrical distribution system, the method including the steps of: providing at least one conductor carrier generally having a longitudinal direction, and a plurality of conductors in the at least one conductor carrier; and connecting a first electrical connector to the plurality of conductors, the first electrical connector including a first part directly connected to at least one conductor carrier, and a second part having a plurality of terminals electrically connected to respective ones of the plurality of conductors, the second part being laterally offset from the first part, and the second part being approximately parallel to the longitudinal direction.

An advantage of the present invention is that it can interconnect adjacent in-line distribution harnesses.

Another advantage is of the present invention is that it avoid mechanical obstacles when interconnecting adjacent in-line distribution harnesses.

Yet another advantage of the present invention is that it can interconnect adjacent distribution harnesses with multiple circuits.

Yet another advantage of the present invention is that it can interconnect adjacent distribution harnesses with both alternating current and direct current circuits.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
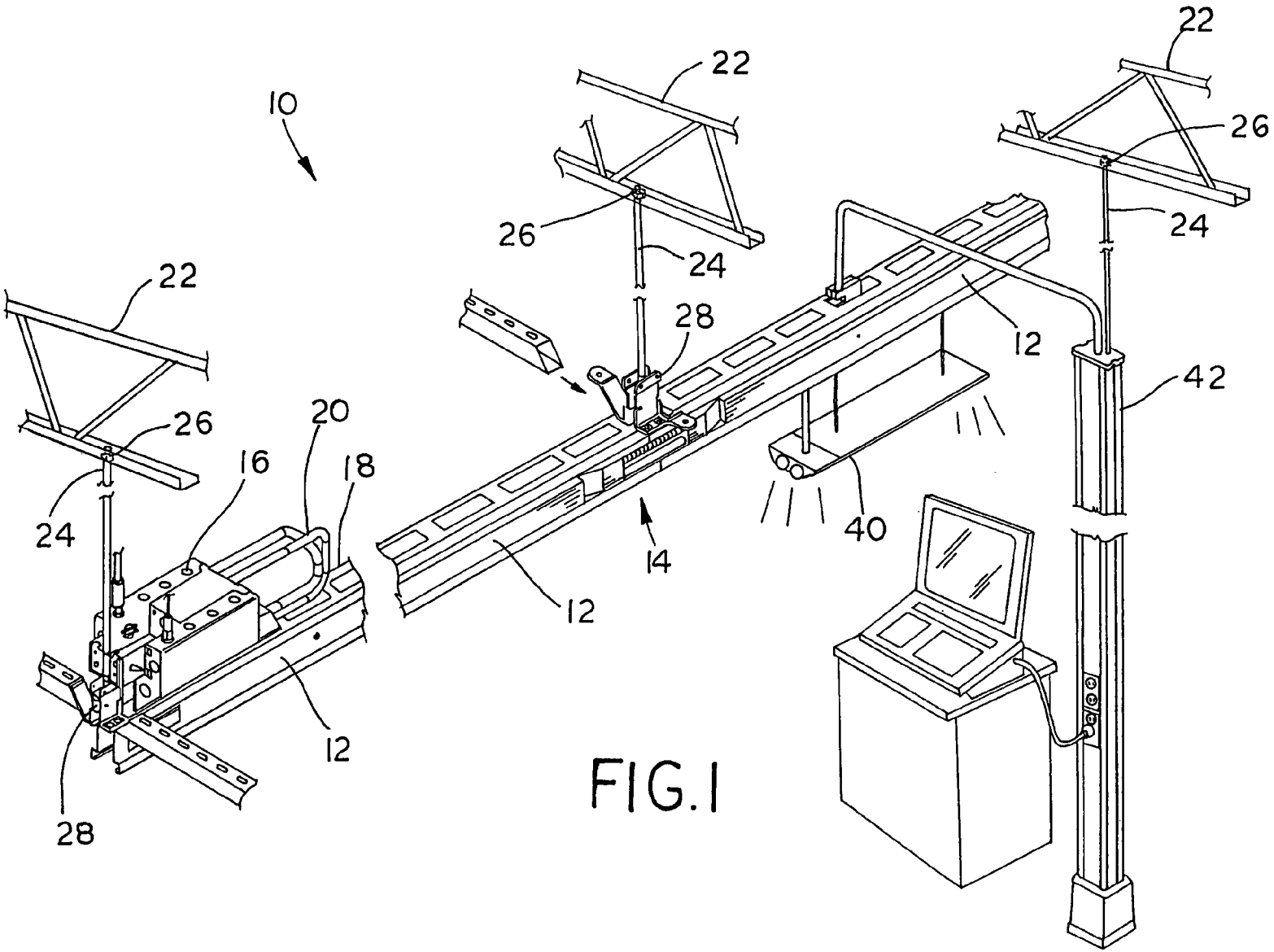
FIG. 1 is a fragmentary perspective view of an embodiment of an electrical distribution system according to the present invention.
Figure 2:
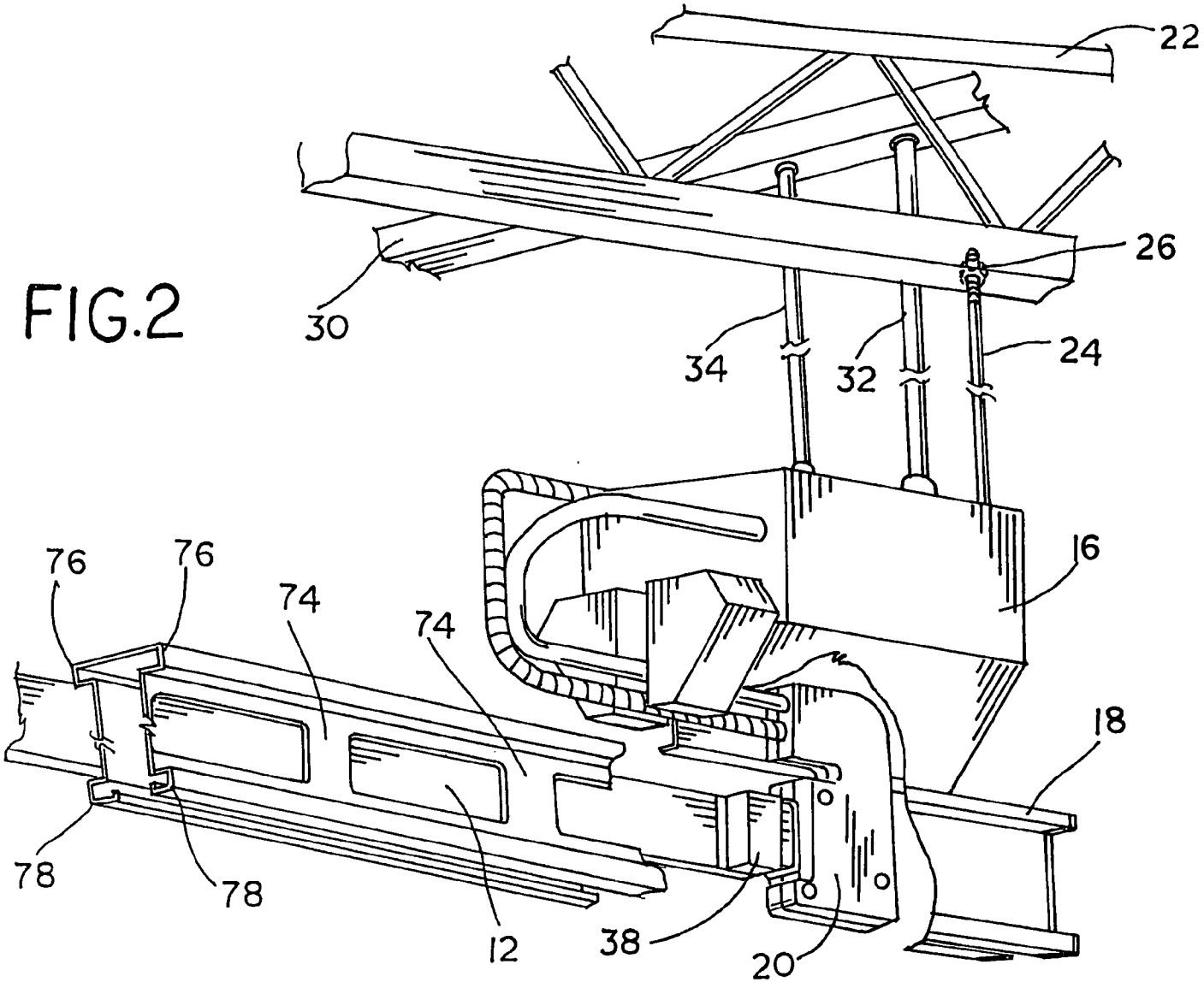
FIG. 2 is a fragmentary perspective view of the electrical distribution system of FIG. 1 showing particularly the power entry assembly.

Referring now to the drawings, and more particularly to FIGS. 1 and 2, there is shown an electrical distribution system 10 which generally includes at least one electrical distribution harness 12, a jumper assembly 14, a power entry box 16, at least one structural element 18 and a power entry assembly 20.

Structural elements 18 can be attached to, and supported by, a ceiling joist 22 via threaded rods 24, fasteners 26 and hangers 28. Raceway 30 can include AC and DC conductors, and other conductors or cables, which are passed through respective AC conduit 32 and DC conduit 34 to power entry box 16. Power entry box 16 is mounted to structural element 18. Power entry box 16 can have suitable internal elements such as bus bars, circuit boards, control elements, etc., to facilitate the routing and control of the AC and DC circuits from respective AC conduit 32 and DC conduit 34. Power entry assembly 20 electrically connects the conductors of power entry box 16 with the conductors of electrical distribution harness 12.

Electrical distribution harness 12 can include harness conductors 36 which can comprise either AC and/or DC circuits, or other circuits such as data circuits. For example, harness conductors 36 can include three line conductors (12 gauge wire), one ground conductor (12 gauge wire) and one neutral conductor (10 gauge wire), and DC conductors as required which may typically include 14 or 12 gauge conductors. Electrical distribution harness 12 includes at least one, and typically a plurality of, electrical distribution connectors 38. Electrical terminals within electrical distribution connector 38 are connected to respective harness conductors 36. Electrical distribution harness 12 can include suitable barriers to separate AC terminals and AC harness conductors 36, from DC terminals and DC harness conductors 36, respectively. Electrical distribution harness 12 can be mounted on either side of structural element 18, but may typically be mounted one side. As shown in FIG. 1, a variety of electrical elements such as a light 40 and a power post 42 can then easily be connected to electrical distribution harness 12 by connection to a respective electrical distribution connector 38.

Jumper assembly 14 is used to interconnect adjacent electrical distribution harnesses 12, and particularly conveys the electrical energies/signals from the conductors of one electrical distribution harness 12 to the conductors of another electrical distribution harness 12. Electrical jumper assembly 14 includes at least one conductor carrier 44, 46 generally having a longitudinal direction 48. A plurality of conductors 50, 52 are carried in respective conductor carriers 44, 46. A first electrical connector 54 is connected to conductors 50, 52. First electrical connector 54 has a first part 56 directly connected to at least one conductor carrier 44, 46, and a second part 58 with a plurality of terminals 60 electrically connected to respective ones of conductors 50, 52. Second part 58 is laterally offset from first part 56, and second part 58 is approximately parallel to longitudinal direction 48. A second electrical connector 62 is connected to conductors 50, 52. Second electrical connector 62 includes a third part 64 directly connected to at least one conductor carrier 44, 46, and a fourth part 66 with a plurality of terminals electrically connected to respective ones of conductors 50, 52. Fourth part 66 is laterally offset from third part 64, and fourth part 66 is approximately parallel to longitudinal direction 48.

The conductor carriers includes a first conductor carrier 44 with a first outside texture 68 and a second conductor carrier 46 with a second outside texture 70. First outside texture 68 is tactile discernably different than second outside texture 70. For example, first conductor carrier 44 can have a relatively smooth oval cross-section and second conductor carrier 46 can have a convoluted cross-section. Alternating current conductors 50 can be carried in first conductor carrier 44 and direct current conductors 52 can be carried in second conductor carrier 46.

Figure 7:
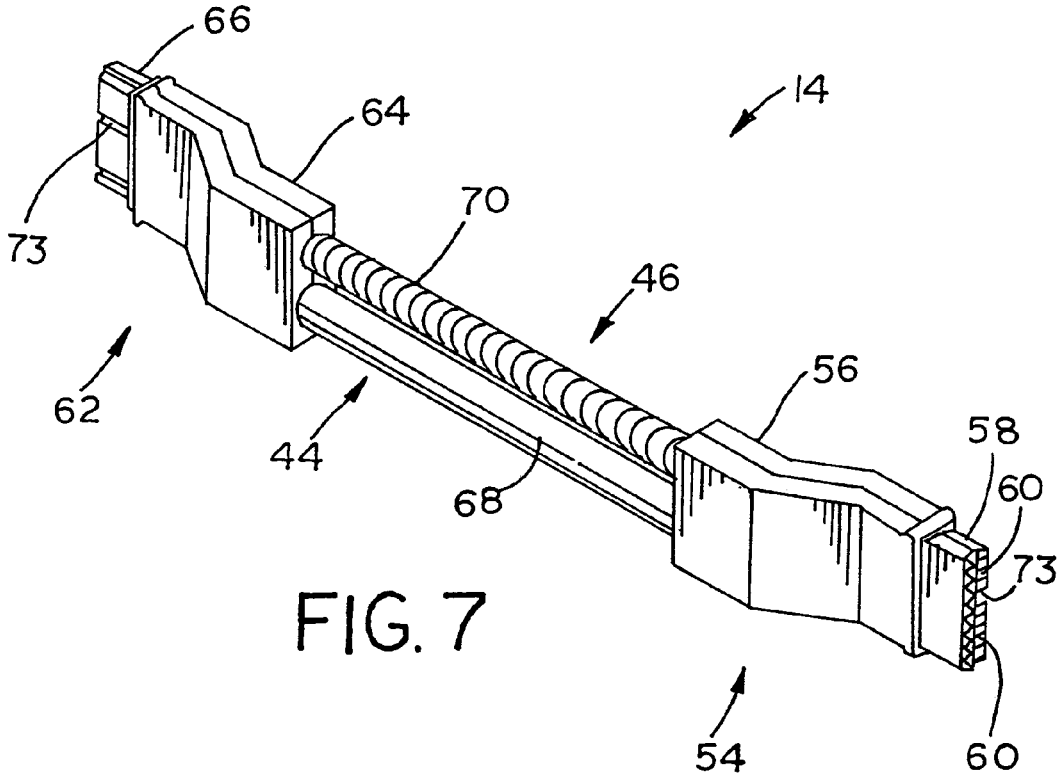
FIG. 7 is a perspective view of the jumper assembly of FIG. 6.
Figure 8:
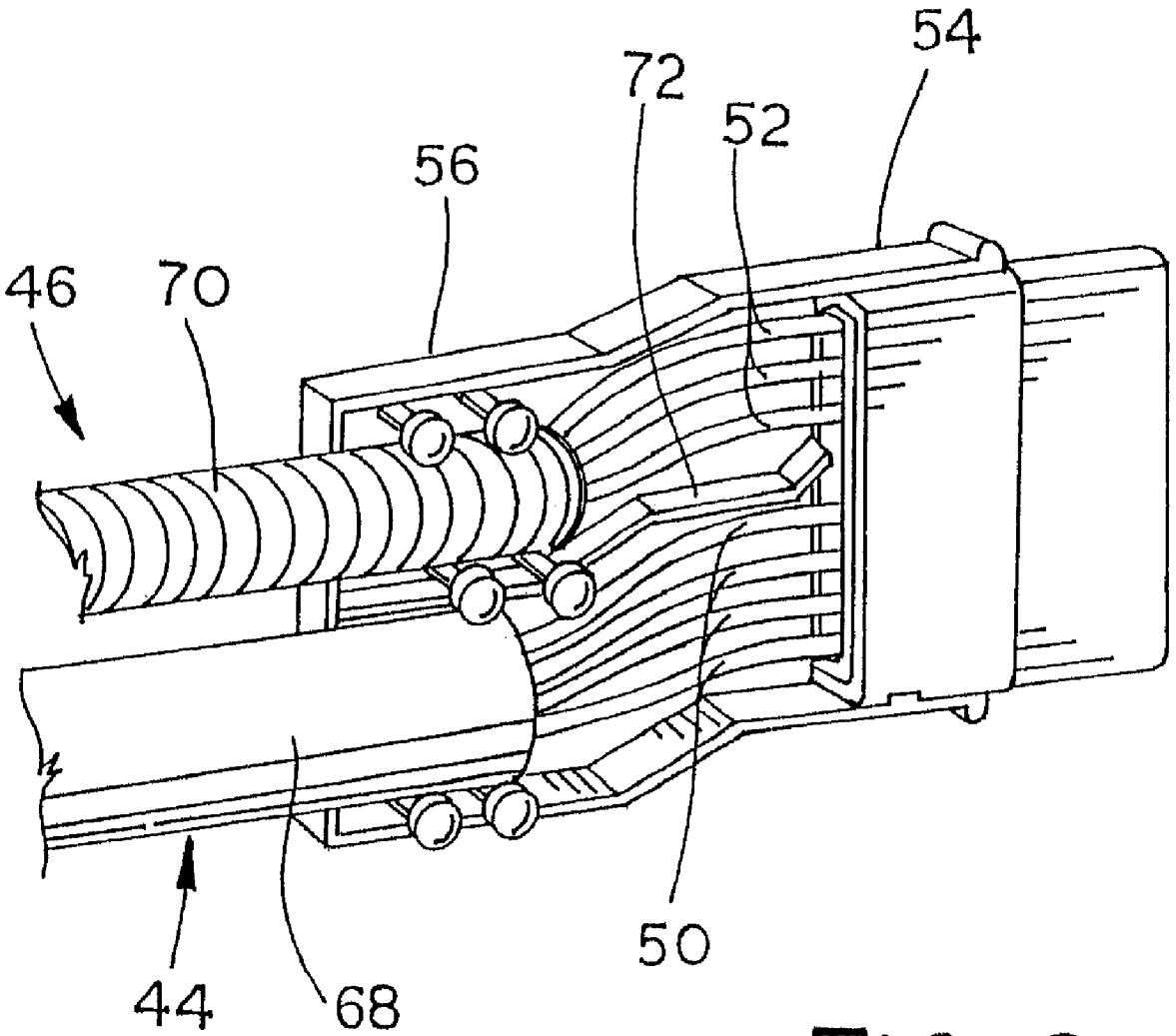
FIG. 8 is a fragmentary perspective view of the jumper assembly of FIG. 6. showing particularly one connector with part of the connector housing removed.

Connector 54 includes AC terminals 60 (lower as shown in FIG. 7) connected to alternating current conductors 50, and DC terminals 60 (upper as shown in FIG. 7) connected to direct current conductors 52, and connector 54 can include a connector barrier 72 and a terminal barrier 73 separating the AC and DC conductors and AC and DC terminals, respectively. Connectors 54 and 62 are similar.

Figure 3:
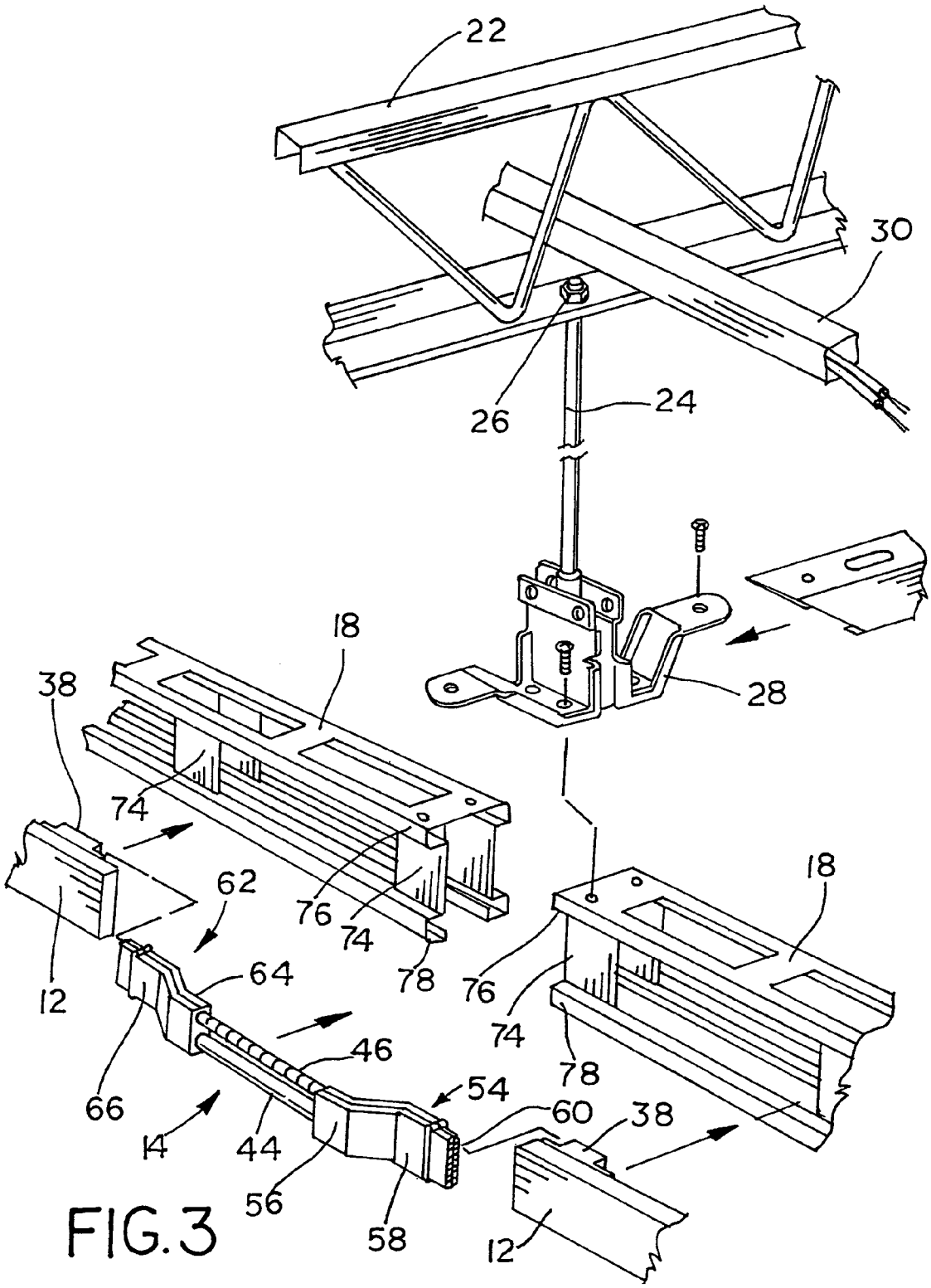
FIG. 3 is an exploded fragmentary perspective view of an electrical distribution system of FIG. 1, showing particularly the jumper assembly exploded from the distribution harnesses.
Figure 4:
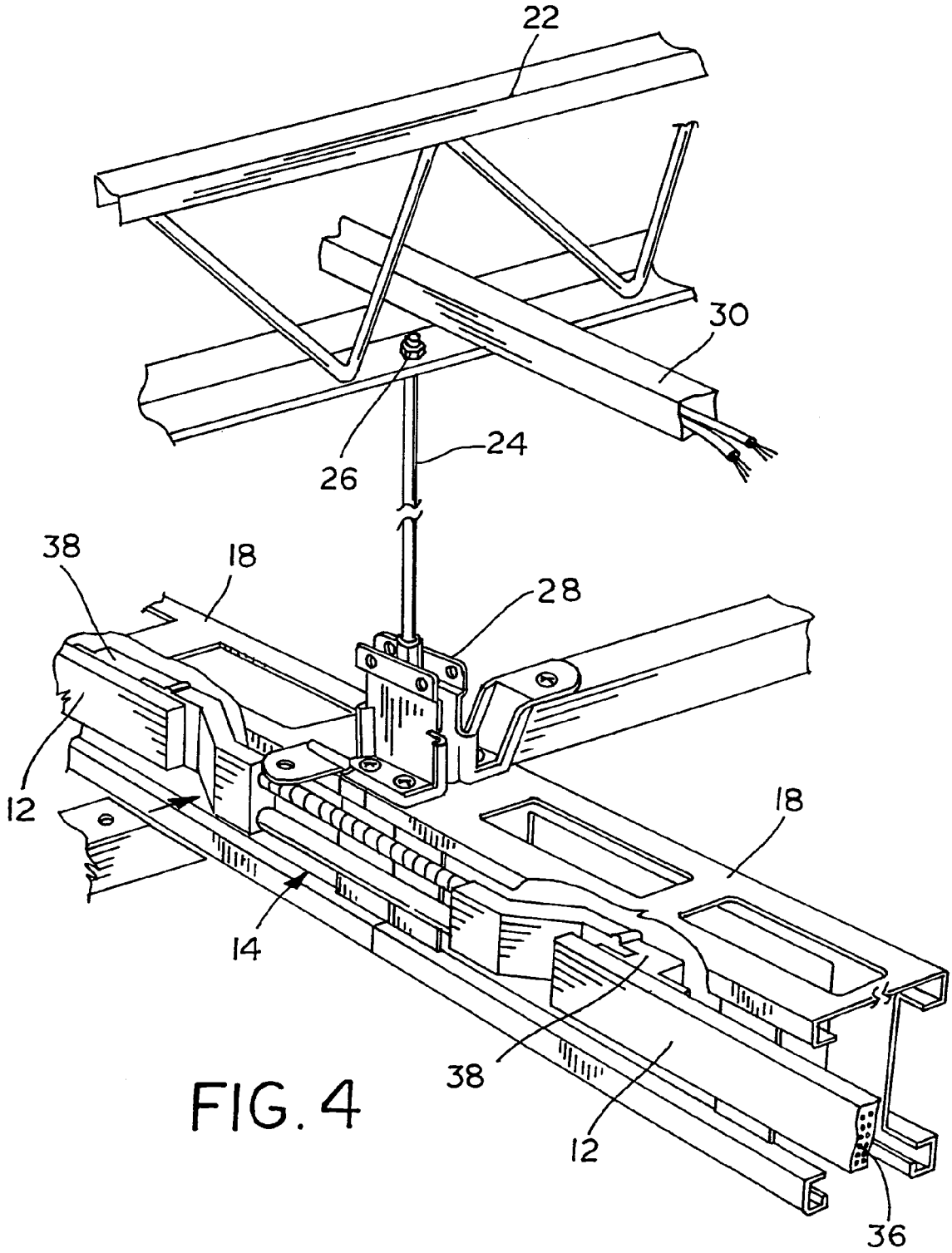
FIG. 4 is a fragmentary perspective view of the electrical distribution system of FIG. 3, shown assembled.
Figure 5:
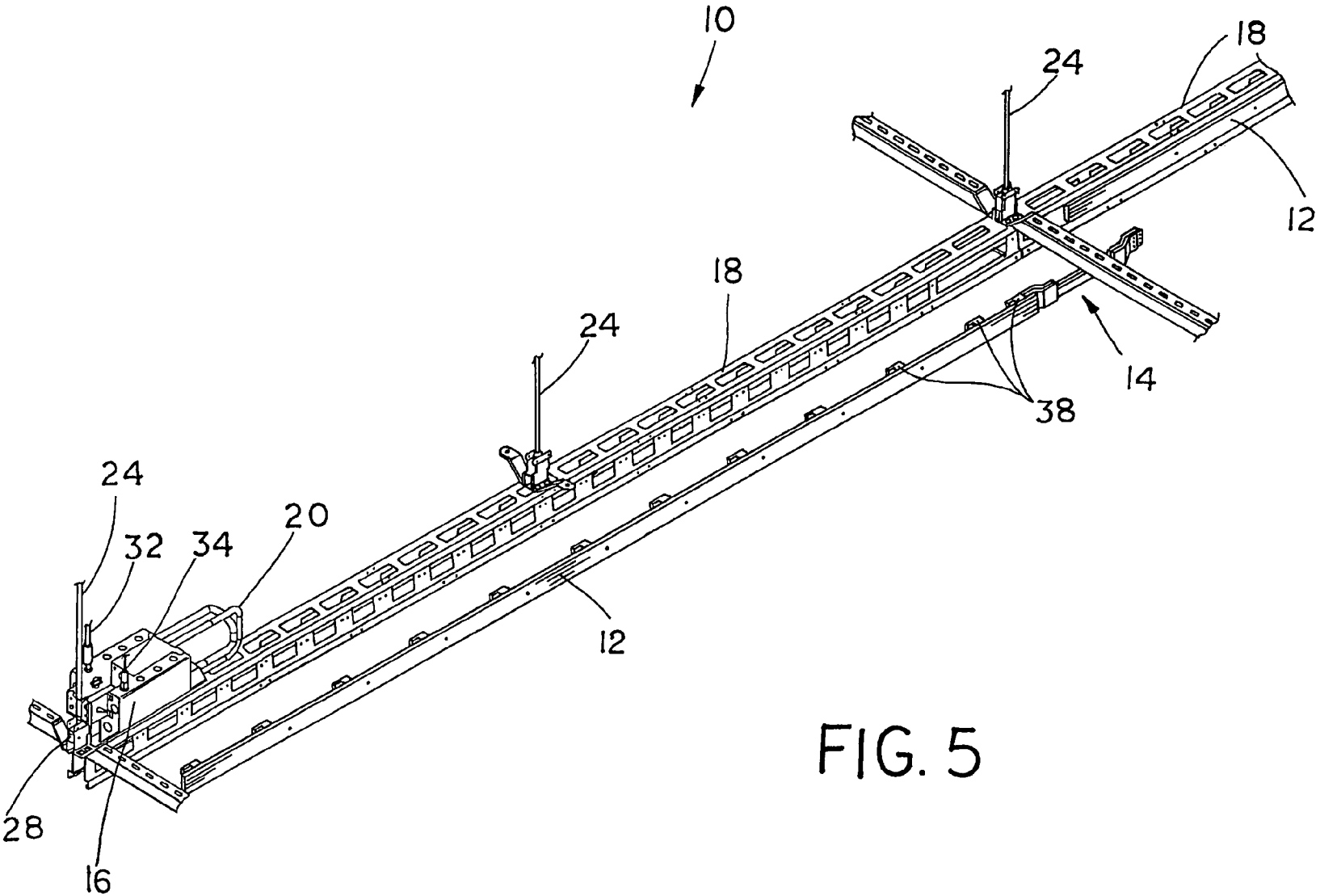
FIG. 5 is a fragmentary perspective view of the electrical distribution system of FIG. 1, shown with one distribution harness and the jumper assembly exploded from the structural element.
Figure 6:
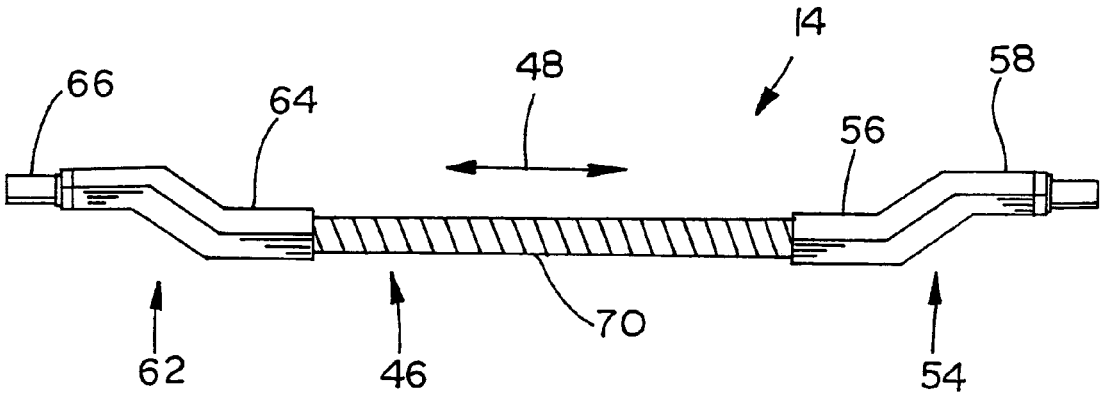
FIG. 6 is a top view of the jumper assembly of FIG. 3.

As shown particularly in FIGS. 2 and 3, structural elements 18 include webs 74 at the ends thereof, and at other places, which interconnect upper and lower rails 76, 78. However, webs 74 at the ends of structural elements 18 obstruct an in-line jumper connection between adjacent in-line electrical distribution harnesses 12. The lateral offset of jumper assembly 14 overcomes this obstruction and allows electrical interconnection of adjacent in-line electrical distribution harnesses 12.

In use, the present invention discloses a method of interconnecting a first electrical distribution harness 12 and a second electrical distribution harness 12 in an electrical distribution system 10, the method including the steps of: providing at least one conductor carrier 44, 46 generally having longitudinal direction 48, and a plurality of conductors 50, 52 in conductor carriers 44, 46; and connecting first electrical connector 54 to conductors 50, 52. First electrical connector 54 has first part 56 directly connected to at least one conductor carrier 44, 46, and second part 58 with terminals 60 electrically connected to respective ones of conductors 50, 52.

Second part 58 is laterally offset from first part 54, and second part 58 is approximately parallel to longitudinal direction 48. The method of the present invention can further include the step of connecting second electrical connector 62 to conductors 50, 52. Second electrical connector 62 includes third part 64 directly connected to at least one conductor carrier 44, 46, and fourth part 66 with a plurality of terminals electrically connected to respective ones of conductors 50, 52.

Fourth part 66 is laterally offset from third part 64, and fourth part 66 is approximately parallel to longitudinal direction 48.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical distribution system, comprising:

an electrical distribution harness including an electrical distribution connector;

an electrical jumper assembly connected to said electrical distribution connector, said electrical jumper assembly comprising:

at least one conductor carrier generally having a longitudinal direction;

a plurality of conductors in said at least one conductor carrier; and a first electrical connector connected to said plurality of conductors, said first electrical connector including a housing, a first part directly connected to said at least one conductor carrier, and a second part including a plurality of terminals electrically connected to respective ones of said plurality of conductors, said second part being laterally offset from said first part, said second part being approximately parallel to said longitudinal direction, said housing having only two ends, said two ends being a first end and a second end, said first part including said first end, said second part including said second end, said housing including a generally S-shaped configuration running from said first end to said second end.

2. An electrical distribution system of claim 1, further including a second electrical connector connected to said plurality of conductors, said second electrical connector including a third part directly connected to said at least one conductor carrier, and a fourth part including a plurality of terminals electrically connected to respective ones of said plurality of conductors, said fourth part being laterally offset from said third part, said fourth part being approximately parallel to said longitudinal direction.

3. The electrical distribution system of claim 1, wherein said at least one conductor carrier includes a first conductor carrier with a first outside texture and a second conductor carrier with a second outside texture, said first outside texture being tactile discernably different than said second outside texture.

4. The electrical distribution system of claim 3, wherein said first conductor carrier has an oval cross-section and said second conductor carrier has a convoluted cross-section.

5. The electrical distribution system of claim 4, further including a plurality of alternating current conductors in said first conductor carrier and a plurality of direct current conductors in said second conductor carrier.

6. The electrical distribution system of claim 5, wherein said first electrical connector includes a first plurality of terminals connected to said plurality of alternating current conductors, and a second plurality of terminals connected to said plurality of direct current conductors, said first electrical connector includes a connector barrier separating said first plurality of terminals and said second plurality of terminals.

7. An electrical jumper assembly, comprising:

at least one conductor carrier generally having a longitudinal direction;

a plurality of conductors in said at least one conductor carrier; and a first electrical connector connected to said plurality of conductors, said first electrical connector including a housing, a first part directly connected to said at least one conductor carrier, and a second part including a plurality of terminals electrically connected to respective ones of said plurality of conductors, said second part being laterally offset from said first part, said second part being approximately parallel to said longitudinal direction, said housing having only two ends, said two ends being a first end and a second end, said first part including said first end, said second part including said second end, said housing including a generally S-shaped configuration running from said first end to said second end.

8. An electrical jumper assembly of claim 7, further including a second electrical connector connected to said plurality of conductors, said second electrical connector including a third part directly connected to said at least one conductor carrier, and a fourth part including a plurality of terminals electrically connected to respective ones of said plurality of conductors, said fourth part being laterally offset from said third part, said fourth part being approximately parallel to said longitudinal direction.

9. The electrical jumper assembly of claim 7, wherein said at least one conductor carrier includes a first conductor carrier with a first outside texture and a second conductor carrier with a second outside texture, said first outside texture being tactile discernably different than said second outside texture.

10. The electrical jumper assembly of claim 9, wherein said first conductor carrier has an oval cross-section and said second conductor carrier has a convoluted cross-section.

11. The electrical jumper assembly of claim 10, further including a plurality of alternating current conductors in said first conductor carrier and a plurality of direct current conductors in said second conductor carrier.

12. The electrical jumper assembly of claim 11, wherein said first electrical connector includes a first plurality of terminals connected to said plurality of alternating current conductors, and a second plurality of terminals connected to said plurality of direct current conductors, said first electrical connector includes a connector barrier separating said first plurality of terminals and said second plurality of terminals.

13. A method of interconnecting a first electrical distribution harness and a second electrical distribution harness in an electrical distribution system, said method comprising the steps of:

providing at least one conductor carrier generally having a longitudinal direction, and a plurality of conductors in said at least one conductor carrier; and connecting a first electrical connector to said plurality of conductors, said first electrical connector including a housing, a first part directly connected to said at least one conductor carrier, and a second part including a plurality of terminals electrically connected to respective ones of said plurality of conductors, said second part being laterally offset from said first part, said second part being approximately parallel to said longitudinal direction, said housing having only two ends, said two ends being a first end and a second end, said first part including said first end, said second part including said second end, said housing including a generally S-shaped configuration running from said first end to said second end.

14. The method of claim 13, further including the step of connecting a second electrical connector to said plurality of conductors, said second electrical connector including a third part directly connected to said at least one conductor carrier, and a fourth part including a plurality of terminals electrically connected to respective ones of said plurality of conductors, said fourth part being laterally offset from said third part, said fourth part being approximately parallel to said longitudinal direction.

* * * * *